United States Patent [19]

Schreiner et al.

[11] Patent Number: 4,788,830

[45] Date of Patent: Dec. 6, 1988

[54] APPARATUS FOR BULK ICE MAKING AND DISPENSING

[76] Inventors: R. Alan Schreiner; Michael S. Schreiner, both of 43895 DeLuz Rd., Rancho California, Calif. 92390

[21] Appl. No.: 25,665

[22] Filed: Mar. 13, 1987

[51] Int. Cl.[4] ..... F25C 5/18

[52] U.S. Cl. ..... 62/344; 62/348; 62/507; 414/306

[58] Field of Search ..... 62/344, 340, 342, 348, 62/420, 421, 424, 506, 507, 508; 414/306, 307; 406/137, 134, 139, 142; 222/146.6, 227, 233, 256, 259

[56] References Cited

U.S. PATENT DOCUMENTS

| | | | |
|---|---|---|---|
| 660,591 | 10/1900 | Russell | 406/164 |
| 1,866,806 | 7/1932 | Holly | 406/160 |
| 2,129,252 | 9/1938 | Whiteside | 302/17 |
| 2,511,246 | 6/1950 | Chamberlin | 406/81 |
| 2,735,591 | 2/1956 | Branchflower | 414/313 |
| 2,791,887 | 5/1957 | Hennig | 62/7 |
| 3,158,407 | 11/1964 | Cymara | 406/160 |
| 3,277,666 | 10/1966 | Simmons | 62/320 |
| 3,794,198 | 2/1974 | Buchele et al. | 214/319 |
| 3,842,993 | 10/1974 | Hagen | 214/17 DB |
| 3,877,241 | 4/1975 | Wade | 62/137 |
| 4,168,805 | 9/1979 | Taylor | 241/101.2 |
| 4,168,937 | 9/1979 | Hagen | 414/298 |
| 4,199,280 | 4/1980 | Allen | 406/56 |
| 4,287,725 | 9/1981 | Hoenisch | 62/344 |
| 4,404,817 | 9/1983 | Cox, III | 62/344 X |
| 4,541,252 | 9/1985 | Reimer | 62/344 |
| 4,612,779 | 9/1986 | Hatton | 62/344 |

OTHER PUBLICATIONS

Ad for "Orbital Ice Storage System" by Price/Macemon Company (no date).

Ad from Semco Mfg. Co. in *American Vegetable Grower,* p. 77 (Nov., 1986).

*Primary Examiner*—Harry B. Tanner

*Attorney, Agent, or Firm*—Brown, Martin, Haller & Meador

[57] ABSTRACT

Apparatus for bulk ice making, storage and dispensing is described. The apparatus comprises an insulated horizontal container with an internal storage chamber having a blower mounted below the ceiling thereof in a position such that ice falling from ice making equipment on the top of the container into the chamber is blown throughout the chamber. Means are provided to move the settled ice into breakers and to dispense it from the chamber to the exterior of the container. Means are also provided to precool the feed water to the ice making equipment and to use chilled air from the storage chamber to maintain a low temperature atmosphere surrounding the ice making equipment to improve efficiency. Preferable the container is an insulated ocean cargo container.

41 Claims, 3 Drawing Sheets

FIG. 1
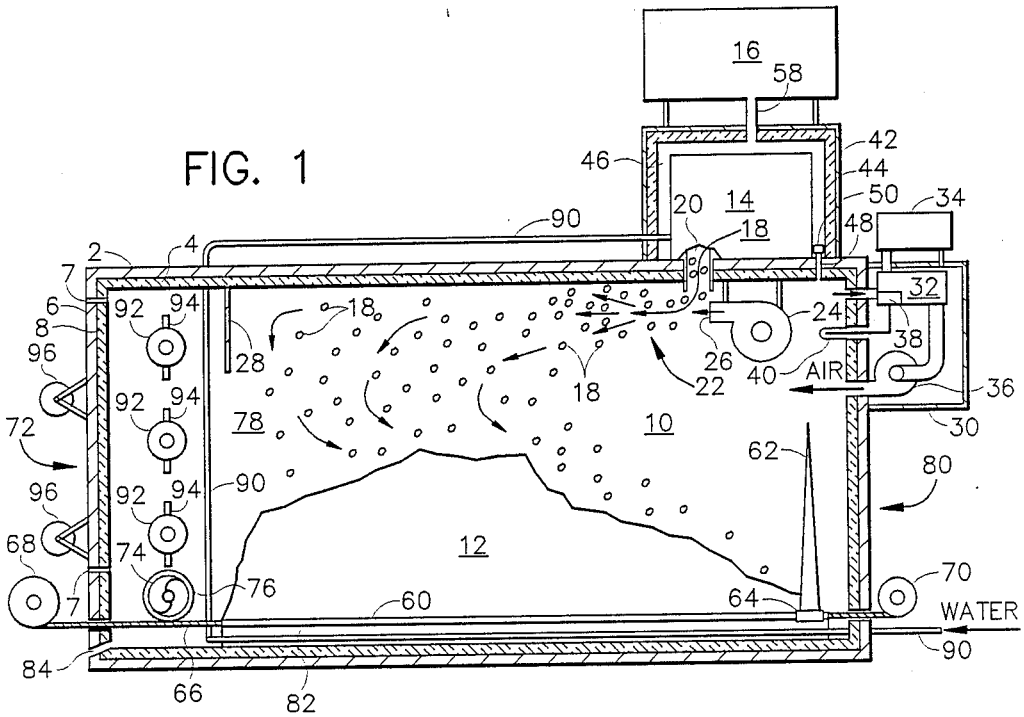
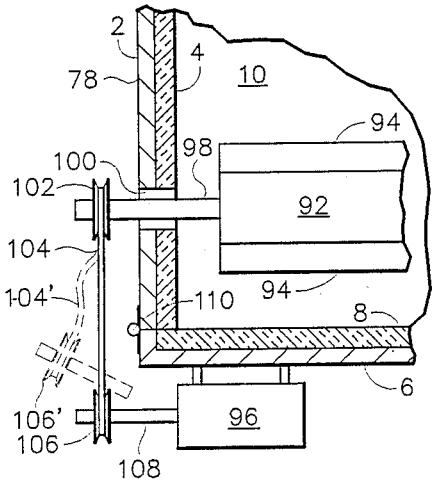
FIG. 2
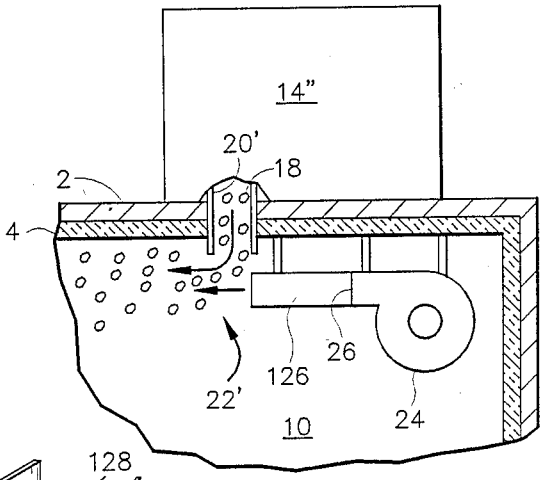
FIG. 4
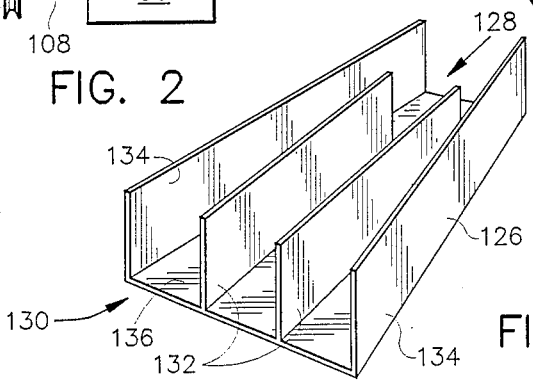
FIG. 5

FIG. 9
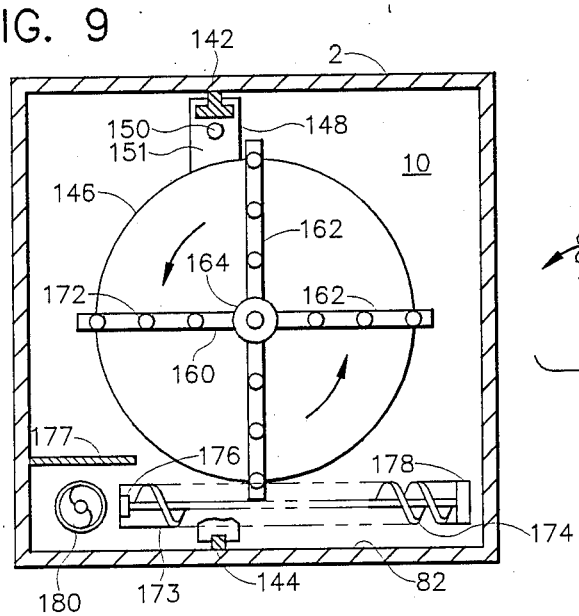
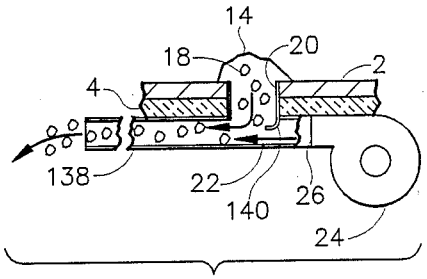
FIG. 11
FIG. 10
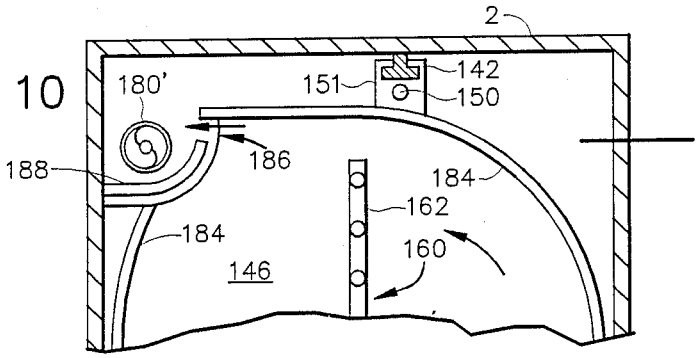
FIG. 12
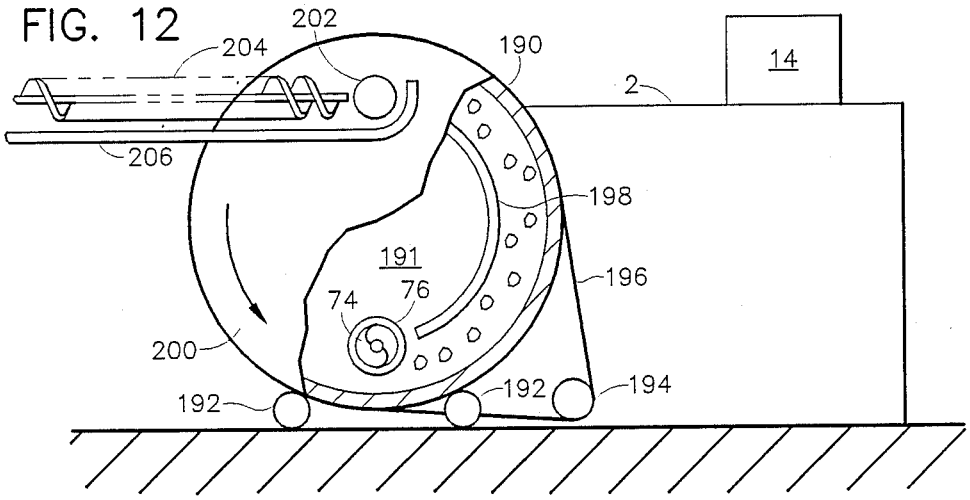

APPARATUS FOR BULK ICE MAKING AND DISPENSING

FIELD OF THE INVENTION

The invention herein relates to devices for the production, storage and dispensing of ice. More particularly it relates to such devices for the production, storage and dispensing of bulk ice in multi-ton quantities.

BACKGROUND OF THE INVENTION

Production and dispensing of large quantities of bulk ice is a major industry. Restaurants, cafeteries, "fast food" outlets, food packing companies, military and other government installations, catering trucks and the like all use many pounds of ice each day. Often the quantities used by a single establishment amount to hundreds or even thousands of pounds of ice per day. Similarly much bulk ice is used daily in agriculture for packing fresh produce. Consequently the ice supply industry has developed facilities to produce, store and dispense bulk ice in such large daily quantities.

Such facilities have in the past, however, been severely limited in the amount of ice they could produce and store without resort to additional ice making machines. This has been due to the inability of the facilities to efficiently use the space within their storage chambers. In the conventional ice facility, the storage chamber is basically oriented vertically, with a height much greater than its width or depth, often extending to several stories in height. The ice making equipment is mounted on the top of the vertical chamber and dispenses the ice downwardly into the chamber. When the accumulated ice pile reaches the top of the chamber the ice making equipment shuts off until some ice is removed from the bottom of the pile and the height of the pile drops.

In such a facility the ice cannot be distributed laterally within the chamber, except to the extent that it may drift slightly as it falls. In order to utilize additional horizontal space within the chamber the operator must install additional ice making equipment at spaced intervals across the top of the chamber. This of course adds to the cost of the facility as well as increasing the amount of equipment maintenance and electric power required.

The vertical orientation of the facility is a disadvantage. In many cases it severely limits the locations at which the facility can be placed, since substantial overhead clearance is required. It also makes equipment installation and maintenance difficult, since work must be done many feet above the ground.

Efforts to design horizontally oriented ice facilities have not heretofore been successful. The problem of efficient ice distribution within the storage chamber has been even greater than with the vertical chambers, since there is much less vertical fall distance for the ice and therefore much less opportunity for the falling ice to disperse laterally. In addition, since the ice accumulates in a generally conical pile, it has quickly reached to the level of the ice making machine discharge and caused the machine to shut off, even though the chamber volume outside the conical ice pile remains empty. It is not uncommon for horizontal facilities to operate at only 75% of actual capacity, and often at much lower levels than that.

An efficient horizontal facility would have the clear advantages of being usable in many different locations, even those where overhead clearance is limited, and of permitting convenient and safe maintenance of equipment. It is the purpose of this invention to define such apparatus.

SUMMARY OF THE INVENTION

The invention herein is apparatus for bulk ice making and dispensing, which comprises:

a. a container enclosing a thermally insulated chamber having sufficient volume to store a commercial quantity of bulk ice;

b. ice making means above and adjacent to the container, with an ice passage from the ice making means discharging into the top of the chamber;

c. blower means disposed beneath the discharge end of the passage adjacent the ceiling of the chamber and oriented to blow discharged ice generally horizontally within the chamber, the blower means producing sufficient air flow to cause the blown ice to be distributed and settled substantially throughout the chamber;

d. conveying means to move at least a portion of the settled ice to means to discharge the ice to the exterior of the container; and e. such exterior discharge means within the chamber and adjacent the floor thereof and communicating with the exterior of the container.

In various preferred embodiments the container is an insulated "sea-going" shipping (ocean cargo) container; the ice passes into a conduit affixed to the blower and is there entrained in the blower's discharge air stream and dispersed from the open end of the conduit to insure that all the ice is subjected to the air stream; there are means to pre-cool the water prior to feeding it to the ice making equipment; the apparatus contains "beaters" to break up the accumulated ice before it passes to the discharge means; there are means to use the cool air within the ice storage chamber to maintain the ice making equipment at a desired low temperature to maximize ice production regardless of the ambient temperature; and/or there are means to maintain a desired low air temperature within the storage chamber. These and other preferred embodiments will be described below.

BRIEF DESCRIPTION OF THE DRAWINGS

FIG. 1 is a sectional side elevation view illustrating the principal components of the apparatus.

FIG. 2 is a partial sectional top plan view of a corner of the apparatus, illustrating drive means for the ice breaking mechanism and the means of automatically disengaging such mechanism when the container access door is opened.

FIG. 4 is a partial sectional side elevation view illustrating a means of dispersing the air flow from the blower to accommodate ice making equipment with wide discharge.

FIG. 5 is a detailed view of the air dispersing device mounted on the blower in FIG. 4.

FIG. 9 is a sectional end elevation view taken on line 9—9 of FIG. 8.

FIG. 10 is a partial sectional end elevation view illustrating another alternative means of moving and dispensing the accumulated ice pile.

FIG. 11 is a partial sectional side elevation view illustrating an alternate means of dispersing the ice by the blower to accommodate certain types of ice making equipment.

FIG. 12 is a plan view, partially cut away, of an exterior dispensing device for use in confined spaces.

DETAILED DESCRIPTION OF THE INVENTION

Figure 3:
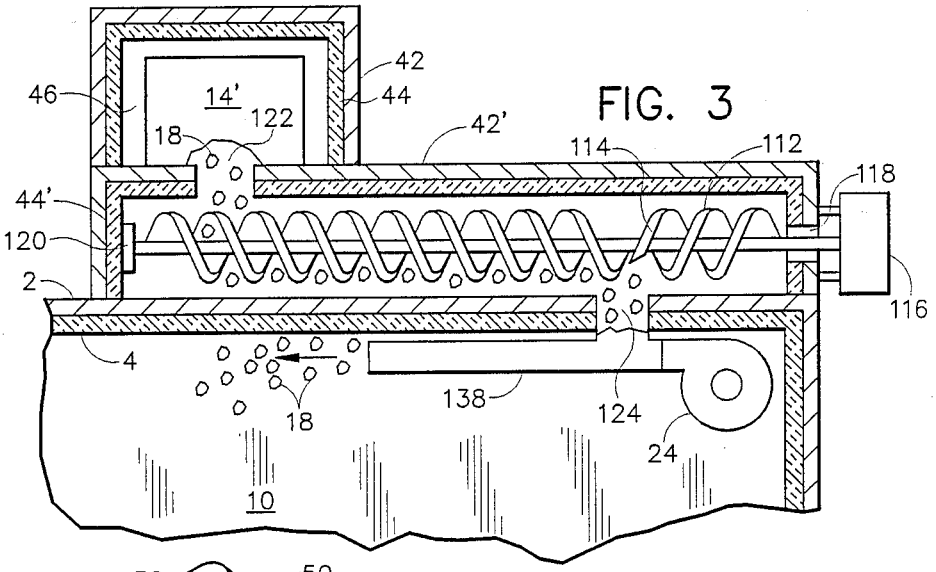
FIG. 3 is a partial sectional side elevation view of an alternate means of passing ice from the ice making equipment to the dispersing blower.

The invention herein is best understood by reference to the drawings. The principal components of the basic system are shown in FIG. 1. The container 2 is a large hollow box, horizontally oriented, which has the capacity to store some 10 to 25 or more tons of bulk ice. It has been found convenient and preferable to use large multi-modal shipping containers as the container 2. A typical such container, of the type used for ocean transport and commonly termed a "sea going" or "ocean cargo" container, has dimensions of 8 feet each in height and width and 20 or 40 feet in length giving a nominal capacity of approximately 1300 or 2500 cubic feet. Since ice has a density of approximately 57 lb/ft$^3$ some 30 tons or more of ice can easily be accommodated. Of course other types of containers, whether made of metal, concrete or other common materials, may also be used. The overall dimensions may also be varied somewhat, although the dimensions of the multi-modal containers stated above have proven to be quite satisfactory for this apparatus. Widths and heights may generally be in the range of 6–10 feet each (and need not be equal) while lengths may vary from 15–50 feet. If dimensions are extended much beyond these ranges the effectiveness of the apparatus is likely to be reduced or else additional ice making equipment will be required. Conversely, if the dimensions are reduced below those given, efficient distribution of the ice within the container will be adversely affected and there are likely to be problems with having sufficient space to mount and operate the internal components.

The container 2 is lined throughout with a layer of thermal insulation 4. Any of the common insulations for use at temperatures of approximately 32° F. or below will be satisfactory, as long as they will not be crushed by the weight of the ice or saturated with water from melting ice. Typical insulations which may be used include polystyrene foam, glass fiber or rock wool boards, polyurethane foams and the like. The thickness of the insulation will be dependent upon the ambient temperatures to which the apparatus will be subjected. Tables and formulas are readily available in the commercial literature to allow one to readily calculate the thickness of insulation needed at a given maximum ambient temperature to maintain the interior of the container at or near 32° F.

The preferred multi-modal containers as commercially available are themselves often insulated with quite sufficient thermal insulation. The type known as an insulated ocean cargo container, for instance, is designed for cargo purposes to be able to maintain interior temperatures for extended periods of time at below 0° F. (often as low as −17° F.) under equatorial ambient conditions. Such containers may conveniently be purchased from shipping companies as used when for other reasons they are no longer considered suitable for ocean transport. Alternatively of course some containers may be purchased new from container manufacturers, such as Fruehauf or ThermoKing.

It is preferred that the container 2 be essentially airtight when in use, to prevent dust and other types of dirt from entering the container and contaminating the ice.

The container preferably also has an exterior access door 6 in one end thereof. This door is insulated with insulating layer 8 and is sealed by thermal insulation strips 7. This door is primarily used for allowing access to the interior chamber 10 by workers for maintenance, cleaning and other purposes. As will be discussed below, the door is interconnected with the drive means of some of the interior components such that when the door is open those components are inoperable and workers inside the chamber 10 are safe from injury.

Within the chamber 10 is the accumulated ice pile 12. The size of this pile varies throughout daily operation as ice is manufactured and deposited in the storage chamber 10 or withdrawn for delivery to purchasers.

The ice is manufactured in a conventional commercial ice maker 14 mounted atop the container 2 and which in turn has an external condenser 16 mounted atop it. The ice making machine 14 discharges ("harvests") ice 18 in pieces through discharge chute 20 through the top of container 2 and the ceiling of chamber 10 into the interior of chamber 10. These pieces of ice may be regular or irregular in shape according to the type of commercial equipment used and generally have largest dimensions on the order of 1–2 inches.

In the simplest embodiment of the invention, the pieces of ice 18 discharging through chute 20 fall directly into the discharge air stream 22 of blower 24, which is mounted adjacent to and directly beneath the ceiling of chamber 10. The discharge nozzle 26 of blower 24 is aligned with chute 20 such that the pieces of ice 18 falling through chute 20 are, upon encountering air stream 22, immediately and strongly blown horizontally into a swirling air environment so that they are rapidly dispersed around the chamber 10. (It should be noted that this embodiment, while the simplest, is not preferred, since ice can too easily fall through the air stream. Preferred in most situations is the embodiment shown in FIG. 11 which will be discussed below.)

The flow of the pieces of ice 18 through the chamber is directed in part by the presence of baffle 28 which extends laterally across the inside of the chamber and extends downwardly for a short distance from the ceiling of chamber 10. While the ice tends to settle initially at a distance away from the blower 24, it has been found that as the ice pile 12 grows the ice becomes relatively uniformly distributed throughout the chamber such that ultimately 90% or greater of the internal capacity can be filled, and often some 95%–98% of the capacity is filled. It has been observed that the interaction of the air flow 22 and the ice pile 12 operates to cause the pieces of ice 18 to travel throughout the chamber 10, even though the blower 24 is fixed and blows in only one direction.

It is desirable to include an air refrigeration unit 30 in the apparatus. This device, which may be a conventional refrigeration unit containing a compressor 32, condenser 34 and blower 36, serves to maintain the air within the chamber at approximately 33° F. to 36° F.

Such a unit is often built into the preferred ocean cargo containers initially and therefore need not be added separately. It is desirable to keep the air temperature within the chamber 10 at slightly above 32° F., so that the ice will not freeze on the interior surfaces of the chamber 10 or the operating components within the chamber. Temperature control is maintained by a conventional controller 38 operably connected to a temperature sensor 40 extending into the chamber 10.

Figure 6:
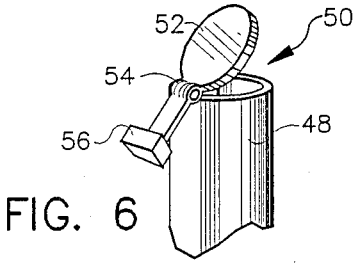
FIG. 6 is a detailed view of the pressure-responsive device for controlling air flow from the storage chamber to the air space surrounding the ice making equipment.

Preferably the ice making equipment 14 is surrounded by housing 42 which has an interior thermal insulation layer 44. The insulated housing 42 is spaced somewhat apart from the ice making equipment 14 to leave an air space 46 surrounding the equipment 14. A conduit 48 with a pressure sensitive regulator 50 allows passage of cool air from chamber 10 into air space 46. This is more fully illustrated in FIG. 6. The conduit 48 is closed by a lid 52 which pivots on hinge 54 and is counterbalanced by weight 56. The weight and balance are selected such that the cool air from chamber 10 flows into air space 46 only when the pressure differential between chamber 10 and air space 46 rises above a predetermined minimum. As the air in air space 46 absorbs heat from the equipment 14 it expands and is slowly vented through vent 58 into condenser 16, then is gradually replaced by air from chamber 10. It has been found preferable to select the pressure differential such that the air temperature in air space 46 will not exceed 60° F. before it is replenished by cooler air from the chamber 10. This allows the ice making equipment to operate efficiently under all types of ambient conditions. It has been observed that even in desert locations this apparatus has easily maintained the temperature in air space 46 at or below 60° F. despite ambient air temperatures which can well exceed 100° F. Similarly, venting the air at 60° F. or below into condenser 16 permits the condenser to operate quite efficiently.

Mounted in the lower part of the chamber 10 and extending from the blower end 80 to near the discharge end 72 is a generally centrally located guide rail 60 on which is slideably mounted a plate or pusher 62 which extends upwardly from the rail 60 to any desired height which will clear blower 24 and deflector 28. The pusher 62 extends almost completely across the interior of chamber 10 leaving clearance for easy movement on both ends of the plate. The sliding base 64 of pusher 62 is mounted on rail 60 and is attached to cable 66 which runs the length of chamber 10 and exits at each end to winches 68 and 70 respectively. Winch 68 pulls cable 66 which urges pusher 62 forward and pushes the accumulated ice pile 12 toward the discharge end 72 of the container 2. Mounted at discharge end 72 is horizontal auger 74 which extends substantially across the lower end of chamber 10. Auger 74 feeds ice out through opening 76 in the exterior wall 78 of container 2 from which it may be blown, dumped or otherwise dispensed into customers' containers, truck mounted ice chests, or any other suitable receptacles. When sufficient ice has been pushed toward auger 74 by pusher 62, the winches 68 and 70 are reversed such that winch 70 pulls the pusher back toward the blower end 80 of the container 2 and new ice can be distributed and settle in front of pusher 62. It is desirable that except when being used to urge forward the ice pile 12, pusher 62 be kept pulled as far back toward blower end 80 of chamber 10 as possible, to minimize the amount of ice which settles behind the pusher 62 and is therefore inaccessible for dispensing from the container 2.

Normally there is a floor 82 within chamber 10 to support the ice pile 12. Usually this will have perforations or openings of some sort to permit melt water from the ice to drain from container 2 through drain 84. The floor 82 may be slightly sloped toward drain 84 for this purpose or the entire container 2 may have a slight slope from end 80 to end 72 to facilitate drainage.

Figure 7:
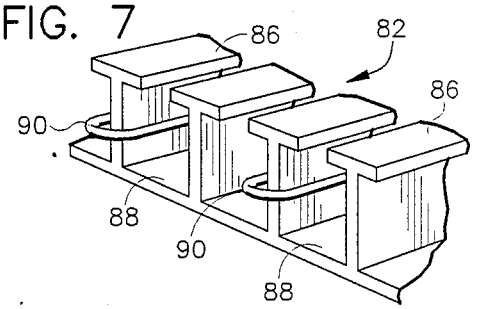
FIG. 7 is a detailed view of a portion of the floor of the storage chamber and water pre-chilling system.

A preferred embodiment of floor 82 is illustrated in FIG. 7. This type of floor is commonly designated a "T-floor". The floor is composed of a number of parallel T-shaped rails 86 with parallel grooves 88 between them. The grooves 88 as recesses facilitate drainage and also serve as the location for components of a preferred water precooling system. In FIG. 7 the T-shaped segments 86 are shown as being widely separated. This is done only for clarity in the drawing; in fact, the segments 86 are usually quite closely spaced with openings of approximately one-eighth inch between them. This permits drainage but minimizes the loss of ice into the recesses 88 where the ice is inaccessible to pusher 62.

The water precooling system consists of tubing 90 which provides water from a supply source (not shown). The tubing enters the lower part of chamber 10 and passes, usually in serpentine fashion, through the grooves (recesses) 88 in floor 82. Any desired number of passes, including a single pass, may be used. After passing through floor 82 the conduit 90 passes upwardly either on the interior or exterior of container 2 to ice making equipment 14. Prechilling the water by exposure to the near freezing air within chamber 10 significantly improves the efficiency of ice making equipment 14. The conduit 90 may be of any suitable material with adequate heat transfer properties. Copper, stainless steel, brass and aluminum tubing are all quite satisfactory. Plastic tubing of various kinds is less preferred because of its poor heat transfer characteristics and tendency to become brittle at low temperatures.

Located at the discharge end 72 of chamber 10 are a plurality of horizontal beaters or breakers 92. These are horizontal cylinders with protruding bars 94, which may themselves have teeth or serrations along their outer edges. As the beaters 92 rotate they serve to break apart any compacted ice as the ice pile 12 is pushed into them by pusher 62. The broken ice then falls into auger 74 for removal from chamber 10. The beaters 92 are driven by motors 96 which are mounted externally of container 2. The drive mechanism is illustrated in FIG. 2. The axial shaft 98 of beater 92 extends through the wall 78 of container 2 is journaled in bearing 100. Mounted at or adjacent to the end of shaft 98 is pulley 102 which is linked by drive belt 104 to a corresponding pulley 106 mounted at or adjacent to the end of shaft 108 of drive motor 96. It will be noted that motor 96 is mounted on the exterior of door 6 of container 2. When door 6 is opened by pivoting on hinge 110 motor 96 is also moved such that pulley 106 assumes the position shown in phantom at 106' putting slack in belt 104 as indicated at 104', thus rendering beater 92 inoperable even if motor 96 should accidentally be turned on which door 6 is opened. This feature thus automatically protects workers who are inside chamber 10 to perform maintenance, repair or installation work with door 6 open.

Some commercial ice makers harvest ice in large quantities (e.g., 100 lbs) essentially all at once (i.e., spread over just a few seconds). The air blowing arrangement shown in FIG. 1 cannot properly distribute such a large quantity of ice in that short time. To over-come this problem one uses the embodiment shown in FIG. 3. An auger 112 is mounted on top of container 2 in a separate housing 42' insulated by insulation 44'. The auger 112 turns on shaft 114 and is driven by motor 116. Shaft 114 is journaled through housing 42' in bearing 118 while its outward end is journaled in bearing 120. Mounted atop housing 42' is ice making equipment 14', which discharges ice 18 through conduit 122 into auger 112. The auger spreads out the flow of ice from the equipment 14' and passes it through second conduit 124 into air stream of blower 24 at a rate that blower 24 can adequately distribute. This embodiment normally requires that the air distribution conduit or pipe 138 (described in more detail in FIG. 11) be used, since a large quantity of ice must be handled in a short time period.

The blower system in FIG. 1 works adequately when the discharge chute 20 is fairly small in diameter and corresponds approximately to the diameter of the discharge 26 of blower 24. For some commercial ice makers, however, the discharge port is quite large, such that without modification the air stream 22 from blower 24 would encounter only a portion of the steam of discharged ice. The embodiment of FIG. 4 accommodates these types of commercial ice makers (here designated 14''). The ice 26 of blower 24 by attaching to discharge 26 an air distributor 126 which is illustrated in FIG. 5. Distributor 126 has a plurality of vanes diverging from the inlet end 128 to the outlet end 130. The vanes 132 and sides 134 spread out the air stream 22' to a width at discharge end 130 which is commensurate with the width of ice discharge chute 20'. The distributor 126 also has a bottom 136 and a corresponding top (which is shown as removed in FIG. 5 for clarity).

FIG. 11 illustrates a preferred embodiment of the air blowing apparatus. Ice 18 discharged from ice making equipment 14 through chute 20 falls into the interior of conduit 138 and there encounters air stream 22 from blower 24. A curved deflector plate 140 directs the ice into the flow stream 22 and also speeds up the air flow to make the entrainment of ice 18 in air stream 22 more effective. No ice is lost by falling through the air stream.

Figure 8:
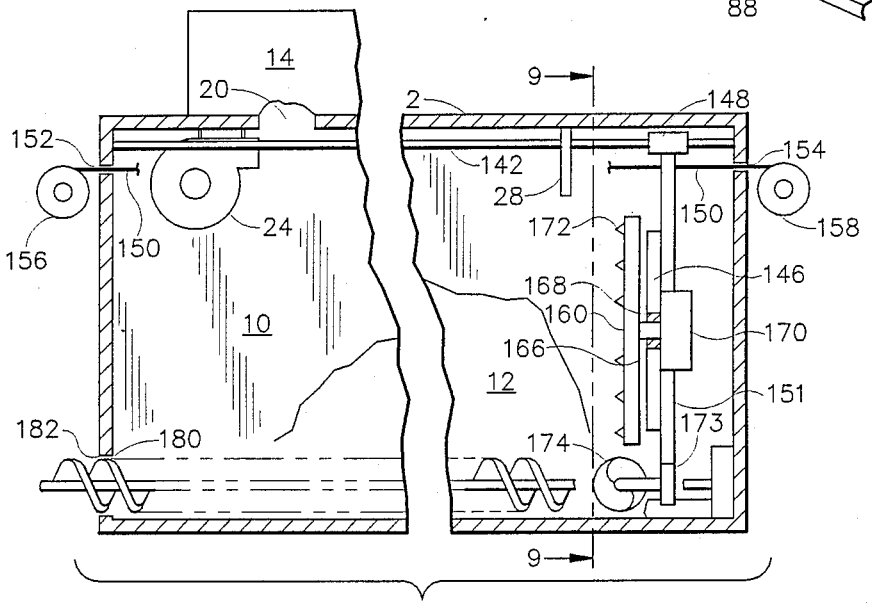
FIG. 8 is a sectional side elevation view, partially cut away, illustrating an alternative means of moving and dispensing the accumulated ice pile.

An alternate method of moving the ice pile 22 within chamber 10 and dispensing the ice to the exterior of container 2 is shown in FIGS. 8 and 9. (In these two Figures and FIG. 10 the insulating layer 4 is omitted for clarity. It will be understood that the insulating layer 4 is present in all embodiments of the apparatus.) In this embodiment there is an overhead rail 142 suspended beneath the ceiling of chamber 10. This rail is preferably mounted slightly off center as illustrated in FIG. 9 to avoid interference with centrally mounted blower 24 and centrally located chute 20. If the blower 24 and chute 20 are themselves located off center, the rail 142 may be centrally mounted. Opposite rail 142 on the floor 82 of chamber 10 is parallel guide 144. Slideably mounted on rail 142 and guide 144 is strut 151 which is suspended from rail 142 by hanger 148. Attached to strut 151 is cable 150 which extends through the length of chamber 10 and passes through openings 152 and 154 in the exterior wall of container 2 to winches 156 and 158. The winches 156 and 158 and cable 150 move strut 151 back and forth through the length of chamber 10 in the same manner as described for cable 66 and winches 68 and 70 in FIG. 1.

Attached to the ice-facing side (i.e., the "front") of strut 151 is plate 146, centrally mounted on which is rotating arm assembly 160. Arm assembly 160 comprises a plurality of arms 162 mounted on hub 164 which in turn is mounted on shaft 166. Shaft 166 is journaled through plate 146 on bearing 168 and is driven by motor 170 which is mounted on the back of plate 146. Preferably there are mounted on the faces of arms 162 protrusions or teeth 172 which aid in breaking up the accumulated ice pile 12.

As strut 151 carries plate 146 forward with assembly 160 rotating the portions of ice pile 12 which they encounter are broken up and drop into auger 174 which is mounted on horizontal bar 153 which is attached to the lower part of the front face of strut 151. The auger is journaled at its free end in bearing 176 mounted on bar 153 and is driven by motor 178 also mounted on bar 153. Auger 174 in turn moves the broken ice pieces to auger 180 which runs the length of chamber 110 adjacent the floor thereof and discharges ice through opening 182 in container 2 to a suitable external collector (not shown) in the same manner as described for auger 74 in FIG. 1. Shroud 177 is mounted above and parallel to auger 180 to prevent falling ice from clogging auger 180.

An alternative to the embodiment shown in FIGS. 8 and 9 which eliminates the need for auger 174 is illustrated in FIG. 10. In this case plate 146 has mounted thereon a generally circular guide 184. The amount by which the guide 184 projects outwardly from the face of plate 146 is approximately equal to the distance by which the rotating mechanism 160 projects from plate 146 so that guide 184 in effect forms a shroud around the mechanism 160. As the mechanism 160 rotates the dislodged ice 118 is conveyed by the air currents formed within guide or shroud 184 to the top of the chamber 10 and there discharged through opening 186 into auger 180'. Auger 180' is equivalent to auger 180 shown in FIGS. 8 and 9 but is relocated to the upper corner of the chamber 10 instead of being at the bottom. A plate 188 extends beneath auger for the length of chamber 10 to provide a path over which the ice is moved by auger 180'.

In some locations there is inadequate space adjacent the container 2 to enable ice purchasers to locate their trucks or other receptacles for filing of ice directly from the container 2. The apparatus shown in FIG. 12 compensates for that and allows the ice to be moved to a convenient dispensing or filing location. A large hollow circular drum 190 is located immediately adjacent to container 2 and positioned such that auger 74 can pass ice through passage 76 directly into the bottom of the interior 191 of drum 190. The outer radial shell 200 of drum 190 rotates on rollers 192 as shown by the arrow, carrying the ice around with it. Rotation of drum 190 is powered by motor 194 driving belt (or chain) 196 which wraps around drum 190. Inside drum 190 is a fixed curved plate 198 which is parallel to but spaced inwardly of shell 200, and which terminates just before opening 202; plate 198 thus serves as a guide for the ice flow. The ice passes upwardly to opening 202 and there moves out of drum 190 into channel 206 in which auger 204 moves it to its intended destination. Alternatively, ice coming out of opening 202 could feed into an air hose or fall into a chute for conveyance to the customers' receptacles.

The equipment herein will for the most part be conventional components readily available from numerous commercial suppliers. The blower 24 is typically a 1–5 hp blower providing 200–1000 cubic feet per minute. Winches will typically have 2–6 tons of pull in one direction with no brake and will be driven by 110 V or 220 V electric motors. The cables 66 and 150 will typically be one-half inch to one inch stainless steel cable. The electric motors driving the beaters and augers will typically be enclosed fan-cooled motors of 2–4 hp and wired for 110 V or 220 V. Because of the moisture within the chamber 10 and the food contact usage of much of the ice it is preferred that all equipment and structures which come in contact with the ice be of materials and grades approved for indirect food contact, such as stainless steel (e.g., Type 304), copper, food grade plastics and the like. Where necessary food grade coverings (as on the insulation or for lining the ice discharge chute) may be used on the ice contact surfaces. It will be evident that these types of materials and equipment are widely available from a wide variety of commercial vendors.

Many different types of commercial ice making equipment can be used in the apparatus of this invention as equipment 14. Satisfactory equipment is commercially available from suppliers such as Carrier, Berg-Morris, Howell and York.

An advantage of use of the various materials preferred herein is that the ice storage chamber and all the components associated with ice making and transport are easily cleaned and maintained in a clean state. This eliminates problems with contamination of the ice, so that the ice can be used for both cooling and for contact with food or human consumption.

It will be evident that there are many embodiments of this invention which are not specifically illustrated or described herein, but which are clearly within the scope and spirit of the invention. The above discussion is therefore intended to be exemplary only and the scope of the invention is to be determined only by the appended claims.

We claim:

1. Apparatus for bulk ice making and dispensing, which comprises:

a. a container enclosing a thermally insulated chamber having sufficient volume to store a commercial quantity of bulk ice;

b. ice making means above and adjacent to said container, with an ice passage from said ice making means discharging into the top of said chamber;

c. blower means disposed beneath the discharge end of said passage adjacent the ceiling of said chamber and oriented to blow discharged ice generally horizontally within said chamber, said blower means producing sufficient air flow to cause said blown ice to be distributed and settled substantially throughout said chamber;

d. conveying means to move at least a portion of said settled ice to means to discharge said ice to the exterior of said container; and e. said exterior discharge means within said chamber and adjacent the floor thereof and communicating with the exterior of said container.

2. Apparatus as in claim 1 wherein said ice discharging from said ice making means discharges from said ice passage directly into the discharge air stream of said blower means.

3. Apparatus as in claim 1 further comprising conduit means extending from the discharge of said blower means and open at the opposite end thereof and disposed such that ice discharging from said ice making means passes into said conduit means at a point adjacent said discharge of said blower means and is there confined in the air stream discharged from said blower means and conveyed out of the discharge end of said conduit.

4. Apparatus as in claim 1 wherein said ice discharging from said ice making means discharges from said ice passage into auger means from which it passes into the discharge air stream of said blower means.

5. Apparatus as in claim 1 further comprising means connected to said exterior discharge means to transport said ice directly to a user's receptacle.

6. Apparatus as in claim 1 further comprising means for regulating the temperature within said chamber.

7. Apparatus as in claim 6 wherein said regulating means comprising means for refrigerating the air within said chamber.

8. Apparatus as in claim 7 wherein said regulating means maintains said temperature in the range of 33° F. to 36° F.

9. Apparatus as in claim 1 wherein said discharge means comprises an auger extending substantially across the said chamber adjacent the bottom thereof and which conveys said ice to the exterior of said container.

10. Apparatus as in claim 9 wherein said conveying means comprises guide means adjacent the bottom of said container and disposed substantially perpendicularly to said auger and which extends from the vicinity of said auger substantially to the opposite end of said chamber, urging means movably mounted on said guide means and disposed to urge said ice toward said auger, and means to drive said urging means along said guide means.

11. Apparatus as in claim 10 wherein said urging means comprises a vertically oriented plate.

12. Apparatus as in claim 10 wherein said drive means comprises a cable secured at both ends to drive motors to enable said cable to be moved in either direction.

13. Apparatus as in claim 1 further comprising an insulated housing enclosing said ice making means and spaced apart therefrom with an air space between said housing and said ice making means, and means to pass cool air from said chamber to said air space to cool said ice making means.

14. Apparatus as in claim 13 wherein said passing means comprises a pressure-sensitive check valve in an air passage communicating between said chamber and said air space.

15. Apparatus as in claim 14 wherein said passing means is capable of maintaining the temperature of the air in said air space at not greater than 60° F.

16. Apparatus as in claim 12 further comprising means to pass air from said air space to the condenser portion of said ice making means.

17. Apparatus as in claim 1 further comprising means within said chamber to break apart portions of said settled ice before said ice passes to said discharge means.

18. Apparatus as in claim 17 wherein said breaking means comprises at least one beater extending substantially across said chamber at the same end thereof as said discharge means and into which said conveying means urges said ice, said beater rotating and thereby breaking apart the settled ice which is brought into contact with it.

19. Apparatus as in claim 18 further comprising deflector means within said chamber adjacent the ceiling thereof, aligned across the path of the discharge air stream from said blower and spaced at a distance from said blower, to deflect blown ice and prevent collection thereof in said breaking means.

20. Apparatus as in claim 1 further comprising means for cooling the water used to make said ice prior to passing said water to said ice making means.

21. Apparatus as in claim 20 wherein said cooling means comprised a heat transfer conduit disposed within said chamber through which said water passes prior to reaching said ice making means.

22. Apparatus as in claim 21 comprises a floor within said chamber containing recesses therein with said conduit being disposed in said recesses.

23. Apparatus as in claim 22 wherein said floor comprises a plurality of parallel supports with parallel recesses therebetween and said conduit is disposed in serpentine manner in said parallel recesses.

24. Apparatus as in claim 1 wherein said container has a door in the end thereof at which said discharge means is located, said door providing access to said chamber.

25. Apparatus as in claim 24 further comprising means to prevent said breaker means from operating while said door is open.

26. Apparatus as in claim 25 wherein said means to prevent operating comprising means to disengage said breaker means from the drive mechanism therefor upon opening of said door.

27. Apparatus as in claim 1 wherein said container comprises a multi-modal shipping container.

28. Apparatus as in claim 27 wherein said container comprises a shipping container of the type designed for ocean transport.

29. Apparatus as in claim 28 wherein said container comprising a shipping container insulated to maintain the interior thereof at a temperature below 0° F. under equatorial ambient conditions.

30. Apparatus as in claim 27 wherein said container has a capacity of at least 20,000 pounds of ice.

31. Apparatus as in claim 30 wherein said container has a capacity of at least 50,000 pounds of ice.

32. Apparatus as in claim 1 further comprising a hollow drum mounted externally of said container and into which said exterior discharge means discharges said ice, said drum rotating to carry ice with it to a second discharge means communicating with the exterior of said drum at a location remote from said exterior discharge means from said container.

33. Apparatus as in claim 32 further comprising means connected to said second discharge means to transport said ice directly to a user's receptacle.

34. Apparatus as in claim 3 wherein said conduit means comprises a hollow enlongated tube.

35. Apparatus as in claim 3 wherein said conduit means contains vanes forming adjacent passages to provide for lateral distribution of the ice.

36. Apparatus as in claim 1 wherein said conveying means comprises a first auger extending lengthwise of said container to convey said ice to the exterior of said container.

37. Apparatus as in claim 36 wherein said conveying means further comprises means movable parallel to said first auger to break up accumulated ice and convey it to said first conveyer.

38. Apparatus as in claim 37 wherein said movable means comprises rotating arms to cut into the accumulated ice and break pieces away and a second auger disposed below said arms and at an angle to said first auger to move said ice pieces to said first auger.

39. Apparatus as in claim 1 further comprising means attached external to said container to convey said ice to a location remote from said container.

40. Apparatus as in claim 39 wherein said means attached comprises lifting means to raise said ice to an elevated level above the discharge level from said container.

41. Apparatus as in claim 40 further comprising conveyor means at said elevated level to move said ice to said remote location.

* * * * *